US011377941B2

(12) United States Patent
Chen et al.

(10) Patent No.: US 11,377,941 B2
(45) Date of Patent: Jul. 5, 2022

(54) GASFLOW DISTRIBUTION DEVICE, GAS DISTRIBUTOR, PIPE STRING AND METHOD FOR SEPARATE-LAYER GAS INJECTION

(71) Applicant: PETROCHINA COMPANY LIMITED, Beijing (CN)

(72) Inventors: Xinglong Chen, Beijing (CN); Jingyao Wang, Beijing (CN); Chengming Zhang, Beijing (CN); Shitou Wang, Beijing (CN); Jiazhong Wu, Beijing (CN); Zhong Ren, Beijing (CN)

(73) Assignee: PETROCHINA COMPANY LIMITED, Beijing (CN)

( * ) Notice: Subject to any disclaimer, the term of this patent is extended or adjusted under 35 U.S.C. 154(b) by 133 days.

(21) Appl. No.: 16/849,283

(22) Filed: Apr. 15, 2020

(65) Prior Publication Data

US 2021/0010356 A1 Jan. 14, 2021

(30) Foreign Application Priority Data

Jul. 9, 2019 (CN) ..... 201910613224.2

(51) Int. Cl.
*F16K 3/26* (2006.01)
*E21B 43/16* (2006.01)

(52) U.S. Cl.
CPC ..... *E21B 43/168* (2013.01)

(58) Field of Classification Search
None
See application file for complete search history.

(56) References Cited

U.S. PATENT DOCUMENTS

2003/0132001 A1 7/2003 Wilson et al.
2004/0035578 A1 2/2004 Ross et al.

FOREIGN PATENT DOCUMENTS

CN 102080524 A 6/2011
CN 103075134 A 5/2013
CN 104912526 A 9/2015
CN 206035462 U 3/2017

OTHER PUBLICATIONS

He, Liu, Yang, Gao , Fuchao, Sun, Fangchao, Liu, Xuebing, Cui , and Yang Qinghai. "Overview of Key Zonal Water Injection Technologies in China." Paper presented at the International Petroleum Technology Conference, Beijing, China, Mar. 2013 (Year: 2013).*

(Continued)

*Primary Examiner* — Charles R Nold
(74) *Attorney, Agent, or Firm* — Foley & Lardner LLP

(57) ABSTRACT

A gasflow distribution device includes an outer pipe, a gland, a filter screen, and a filling block with a pore structure. The outer pipe is a hollow outer pipe, used for placing the filling block, with an open upper end and a lower end with a bottom of which the center part is provided with a bottom hole, wherein the filling block is sealed to an inner wall of the outer pipe. The gland has a bottom end provided with a circular groove for setting the filter screen, and a top end distributed evenly with a plurality of top holes through the gland. The gland is connected to the outer pipe. The device can distribute gasflow proportionally, and can be used for separate-layer gas injection.

12 Claims, 6 Drawing Sheets

(56) References Cited

OTHER PUBLICATIONS

Wang, Zhou, Chaoyang, Xie, Jingshen, Li, and Wang Fengshan. "Development and Practice of Separate Layer Production Technique in Daqing Oilfield." SPE Advanced Technology Series 5 (1997) (Year: 1997).*
English-language translation of Chinese Search Report, 13 pages (dated Jun. 27, 2019).

* cited by examiner

GASFLOW DISTRIBUTION DEVICE, GAS DISTRIBUTOR, PIPE STRING AND METHOD FOR SEPARATE-LAYER GAS INJECTION

CROSS-REFERENCE TO RELATED APPLICATION

This application claims priority to Chinese Patent Application No. 201910613224.2, filed on Jul. 9, 2019, which is hereby incorporated by reference in its entirety.

TECHNICAL FIELD

The present disclosure relates to a gasflow distribution device, a gas distributor, a pipe string and a method for separate-layer gas injection, and belongs to the technical field of oil field development.

BACKGROUND

The separate-layer water injection technology is commonly used in medium- to high-permeability reservoirs. That is, the water amount to be injected is adjusted according to the permeability and water absorption of the corresponding oil layer, so that each oil layer can have high-quality oil displacement. Conversely, the high-permeability reservoir will become the main flow channel for liquid if water injection is performed in a non-differential manner. In this case, most of the injected water will flow away along the high-permeability reservoir, while the low-permeability reservoir will be lowly distributed in water flow, resulting in significantly poor oil displacement effect. The conventional separate-layer technology is illustrated in FIG. 1 taking two-oil-layer injection as an example to show its operation process, wherein packers 2 are installed at the upper and lower ends of the corresponding reservoir, water distributor 1 is installed in the middle part, and the water nozzle 3 in the water distributor 1 has an aperture selected according to the requirements of the water injection.

Among those, the water distributor is easy to replace and operate. FIG. 2*a* illustrates a simplified structure of the water distributor. As can be seen from it, the water distributor includes a water nozzle 3, a core 4, and an O-ring 5. FIG. 2*b* illustrates schematically the principle of the flow control by using the water nozzle 3.

The water flow is in a turbulent state due to the large amount of water injection, which is expressed by the Darcy-Weissbach equation as follows:

$$h_f = f\frac{L}{D}\cdot\frac{U^2}{2g}; \qquad \text{Equation 1}$$

In Equation 1: hf—head loss; L—pipe length; D—pipe inner diameter; U—average speed; f—friction coefficient.

The diameter of the water nozzle is selected upon calculation according to the above Equation 1, wherein the friction coefficient involves multiple properties such as water viscosity and inner wall roughness of the pipe.

Generally, the bottom of a water-injection well are under the following conditions: a temperature of 40° C. to 90° C., a pressure of 10 MPa to 40 MPa and a daily water injection volume of 5 $m^3$ to 50 $m^3$. Within this range, the water nozzle has a frequently used diameter such as 3 mm, 5 mm or 8 mm in the wellbore.

Theoretically, the flow control may be also realized by gas injection in a similar way to achieve an effect of separate-layer distribution. However, the water nozzles having the existing apertures are not applicable due to the low viscosity and low density of gas. The above Equation 1 is also applicable to gas in principle. Provided only the difference in viscosity between gas and water is considered, under the condition of the same pressure difference (head loss), flow rate, and length, the aperture of the gas device is about 0.03 times of the diameter of the water nozzle, that is 100 μm. Strict calculation for the gas flow is shown in Equation 2, which is also derived from Equation 1 and has more comprehensive consideration of gas properties.

The Equation 2 is derived from the above Equation 1 in a turbulent state for gas:

$$P_1^2 - P_2^2 = f\frac{L}{D}\cdot\frac{QRT}{gA^2}; \qquad \text{Equation 2}$$

In Equation 2: P1, P2—inlet and outlet pressure; Q—gas flow; R—gas constant; T—temperature; A—inner cross-sectional area of pipe; g—gravitational constant.

The use of separate-layer gas injection by changing the diameter of the nozzle was unsuccessful in the laboratory and on site. It is analyzed and considered to have two reasons:

(1) It is inevitable that solid impurities 6, more commonly kerites, are present in the injected water on site. The impurities and kerites can pass through a hole of millimeters, but easily cause clogging in a hole of hundred microns; especially the kerites will completely fill the water nozzle 7 over its length, causing the clogging effect more obvious. The use of a filter screen may have little effect, because there is only one channel to the outlet. The protection effect will be lost after the filter screen is fully loaded. The process is schematically shown in FIG. 3.

(2) The flush effect of gas on the holes is significantly higher than that of water under the same pressure difference and the same flow rate. The presence of solid impurities will cause larger damage, causing gradually increased apertures, and lose of flow controlling.

Therefore, providing a gasflow distribution device, a gas distributor, a pipe string and a method for separate-layer gas injection has become technical problems that urged to be solved in the art.

SUMMARY

In view of above disadvantages and shortcomings, an object of the present disclosure is to provide a gasflow distribution device.

Another object of the present disclosure is to provide a gas distributor.

Still another object of the present disclosure is to provide a pipe string for separate-layer gas injection.

Another object of the present disclosure is to provide a method for separate-layer gas injection.

To this end, in one aspect, the present disclosure provides a gasflow distribution device, wherein the gasflow distribution device includes: an outer pipe, a gland, a filter screen, and a filling block with a pore structure.

The outer pipe is a hollow outer pipe, used for containing a filling block with a pore structure, with an open upper end and a lower end with a bottom of which the center part is provided with a bottom hole, wherein the filling block is sealed to the inner wall of the outer pipe.

The gland has a bottom end provided with a circular groove for setting the filter screen which is sealed to the inner wall of the circular groove, and a top end distributed evenly with a plurality of top holes through the gland;

The gland is connected to the outer pipe via an inner screw thread, and the filter screen is pressed tightly against the filling block with a pore structure after the gland is connected to the outer pipe.

According to a specific embodiment of the present disclosure, in the gasflow distribution device, preferably, the bottom hole has a diameter of not less than 3 mm.

According to a specific embodiment of the present disclosure, in the gasflow distribution device, preferably, the filter screen is a screen with a mesh of 60 to 100.

More preferably, the filter screen is a screen with a mesh of 80. The larger mesh of the filter screen used in the present disclosure is mainly to prevent larger solid particles from flowing into the gasflow distribution device.

According to a specific embodiment of the present disclosure, in the gasflow distribution device, preferably, the top hole has a diameter of 1 to 2 mm.

More preferably, the top hole has a diameter of 1 mm. The resistance to gas flow is negligible when the top holes have a diameter of 1 mm.

According to a specific embodiment of the present disclosure, in the gasflow distribution device, preferably, an amount of epoxy resin is filled between the filling block and the inner wall of the outer pipe so that they are sealed after curing.

The sealing may be formed between the filling block and the inner wall of the outer pipe to prevent gas from flowing along the annulus between the filling block and the inner wall of the outer pipe in the present disclosure.

According to a specific embodiment of the present disclosure, in the gasflow distribution device, preferably, an amount of epoxy resin is filled between the filter screen and the inner wall of the circular groove so that they are sealed after curing.

According to a specific embodiment of the present disclosure, in the gasflow distribution device, preferably, the filling block with a pore structure has a pore permeability (Kc) which is not higher than 0.1 times of the permeability (Kr) of the target reservoir, a channel diameter of 1 to 2 μm, and a tortuosity of 1.4 to 1.57.

More preferably, the filling block with a pore structure has a tortuosity of 1.57 based on the uniform distribution of the whole particles.

According to a specific embodiment of the present disclosure, in the gasflow distribution device, preferably, the filling block with a pore structure is sintered from titanium nano-scale particles in a high-pressure and oxygen-free environment.

According to a specific embodiment of the present disclosure, in the gasflow distribution device, preferably, the titanium nano-scale particles have a diameter of 30 to 50 nm.

The filling block with a pore structure used in the present disclosure is commercially available, or can also be made of titanium nano-scale particles. The titanium nano-scale particles are finely screened in their diameter and thus have a high uniformity. The titanium nano-scale particles are sintered in a high-pressure and oxygen-free environment to form a filling block structure with a certain permeability. The pressing thickness (such as 1 to 3 mm), pressure and sintering degree during the preparation process are the key factors to control the pores, channel diameter and tortuosity. The pressing thickness, pressure, temperature, and sintering degree may be set by a person skilled in the art during the preparation process according to the on-site performance requirements of the filling block with a pore structure as used, as long as the prepared filling block with a pore structure can achieve the purpose of the present disclosure.

When using the gasflow distribution device provided by the present disclosure, the gas enters from the top holes of the gland, passes through the filter screen and the filling block with a pore structure, and then flows out from the bottom holes in the lower part of the outer pipe.

In another aspect, the present disclosure also provides a gas distributor, which includes a core having an outer wall of which the upper and lower ends are sleeved with O-rings respectively, and having a sidewall which is provided with sidewall holes, wherein the gas distributor further includes the gasflow distribution device as above described provided inside the core, wherein the bottom holes of the gasflow distribution device are connected to the sidewall holes of the gas distributor through pipelines. In the gas distributor, the pipeline not only functions to connect the gasflow distribution device and the sidewall holes, but also functions to support the gasflow distribution device.

According to a specific embodiment of the present disclosure, in the particular structure of the gas distributor according to the present disclosure, the configuration of components such as the core and the O-ring can be those in the water distributor currently used in separate-layer water injection. That is to say, it can be considered that the gas distributor according to the present disclosure is obtained by installing the above-mentioned gasflow distribution device inside the core of a water distributor, which does not change the structure and external dimensions of the core of the water distributor. It only requires to replace the core when necessary, while the operation is the same as that in the separate-layer water injection process.

The water distributor has a water nozzle having a single-hole structure with a limited length and diameter. In addition to directly reducing the hole diameter, the length may be correspondingly extended, that is, the tortuosity of the channel may be increased to achieve the same technical effect as reducing the hole diameter, as seen from the analysis in Equation 1. The number of channels can be increased to prevent clogging. Although the porous structure means that the channel diameter needs to be smaller, which contradicts with the prevention of clogging, the two factors may be associated through variation of the channel structure. FIGS. 4*a* to 4*b* illustrate the design principle of the filling block with a pore structure used in the gasflow distribution device of the present disclosure. As can be seen from FIGS. 4*a* to 4*b*, a single straight channel and two (or multiple) high tortuous channels with the same diameter are shown in FIGS. 4*a* to 4*b* respectively in the same length. Under the same pressure difference, the two models have the same flow. Obviously, the model shown in FIG. 4*b* has an enhanced effect to prevent clogging.

Similarly, a pore structure similar to sandstone may be selected, as shown in FIG. 5. From FIG. 5, it can be seen that the pore channels formed between the solid particles 9 have the characteristics such as high tortuosity, small average diameter, and drastic microscopic changes in channel diameter. These characteristics are beneficial for controlling the amount of distributed gas.

The pore structure of natural sandstone has a gas passing capacity which can be expressed by permeability as a whole and can be measured quantitatively. However, this structure has a defect that its pore structure usually has poor uniformity, which easily leads to the formation of one or several main channels, and the structure of the natural sandstone facilitates no massive manufacture. Particles with a good circularity as shown in FIGS. 6*a* to 6*b* are used for an even distribution in order to improve the uniformity of the channel structure. The pore space as obtained has a significant regularity so that the uniformity is greatly improved. Although arranging smaller particles in the space formed by larger particles can effectively reduce the channel diameter in the structure shown in FIG. 6*b*, it is not recommended because of poor operability and difficulty in controlling uniformity. In the structure shown in FIG. 6*a*, the channel diameter can be reduced by decreasing the particle size of the solid particles.

It can be seen that installing a pore structure material with a high uniformity and high tortuosity at the position of the water nozzle can control the gasflow distribution of the injected gas.

At this time, Equations. 1 and 2 can be converted into Darcy's seepage equation, as shown in Equation 3 below:

$$Q = K\frac{\Delta P \cdot A}{\mu L}; \qquad \text{Equation 3}$$

In Equation 3: Q—flow rate; K—permeability; ΔP—pressure difference; A—cross-sectional area; L—length; μ—fluid viscosity.

In another aspect, the present disclosure also provides a pipe string for separate-layer gas injection, including a heat insulating oil pipe, a plurality of packers, and a plurality of the above-mentioned gas distributors and a sealing unit. The packer and the gas distributor are connected to the heat insulating oil pipe at intervals in sequence, and the heat insulating oil pipe has a bottom end which is sealed up by the sealing unit.

According to a specific embodiment of the present disclosure, in the pipe string, preferably, the plurality of packers and gas distributors are two packers and gas distributors, respectively.

According to a specific embodiment of the present disclosure, in the pipe string, preferably, the sealing unit is a screwed plug.

In yet another aspect, the present disclosure also provides a method for separate-layer gas injection, including the following steps:

(1) Determining the number of oil layers for separate injection and the gas injection volume for each oil layer, and then determining the permeability of the filling block with a pore structure as used according to the ratio between the gas injection volumes for each oil layer to select an appropriate filling block;

(2) Sending down the pipe string for separate-layer gas injection as above into a position corresponding to the oil layer for separate-layer gas injection, during which the gas flow is distributed automatically and proportionally.

According to a specific embodiment of the present disclosure, in the method, preferably, the ratio between permeabilities of the filling blocks with a pore structure is the same as a ratio between the gas injection volumes for the corresponding oil layers.

According to a specific embodiment of the present disclosure, in the method, preferably, the oil layers for separate injection are 5 or less in number.

A uniform and highly tortuous porous-structure material is adopted in the present disclosure to realize the gas flow control, which is combined with the structure of a conventional water distribution device to obtain a gasflow distribution device that may have a function to distribute the gas flow proportionally, and a method to apply such device. The gasflow distribution device shows a good distribution effect when applied in a process for 5 or less formations (usually no more than 2 formations for water injection in medium-to-low permeability reservoirs).

The present disclosure has the following advantages:

1. The gasflow distribution device provided in the present disclosure and the method for separate-layer gas injection using the gasflow distribution device enables creation of the gas displacement mechanism, breaking the situation where the gas injection process cannot be controlled;

2. The present disclosure also provides a porous structure material with uniform particle diameter and high tortuosity and a method for manufacturing the same. The gasflow distribution device containing the porous-structure material has the advantages of high precision in regulating gas resistance and ease to realize a certain resistance level;

3. The present disclosure also provides a gas distributor, which is suitable for separate-layer gas injection under existing separate-layer water injection conditions;

4. The separate-layer gas injection method provided in the present disclosure is suitable for low-permeability oil reservoirs which has poor water injection effects but suitable for gas injection development. The method can improve the efficiency of gas injection development.

BRIEF DESCRIPTION OF THE FIGURES

The figures used for the description of Examples are briefly explained below to provide clearer description for Examples of the present disclosure or the prior-art technical solutions. Obviously, the figures in the following description are just some examples of the present disclosure and other variations can be obtained based on these figures by ordinary persons skilled in the art without creative efforts.

DESCRIPTION FOR NUMERICAL REFERENCES

A, First oil layer;
B, Second oil layer;
0, Heat insulating oil pipe;
1, Water distributor;
2, Packer;
3, Water nozzle;
4, Core;
5, O-ring;
6, Solid impurities;
7, Water nozzle holes;
8, Screwed plug;
9, Solid particles;
10, Gasflow distribution device;
11, Outer pipe;
12, Gland;
13, Filter screen;
14, Filling block with a pore structure;
15, Top holes;
16, Bottom holes;
17, Screw thread;
18, Sidewall holes;
21, First packer;
22, Second packer;
23, First gas distributor;
24, Second gas distributor.

DETAILED DESCRIPTION

The present disclosure will be described in detail with reference to the following examples to provide more clearly comprehension of the technical features, objects, and beneficial effects of the present disclosure, which, however, cannot be construed as limiting the implementable scope of the present disclosure.

Example 1

Figure 1:
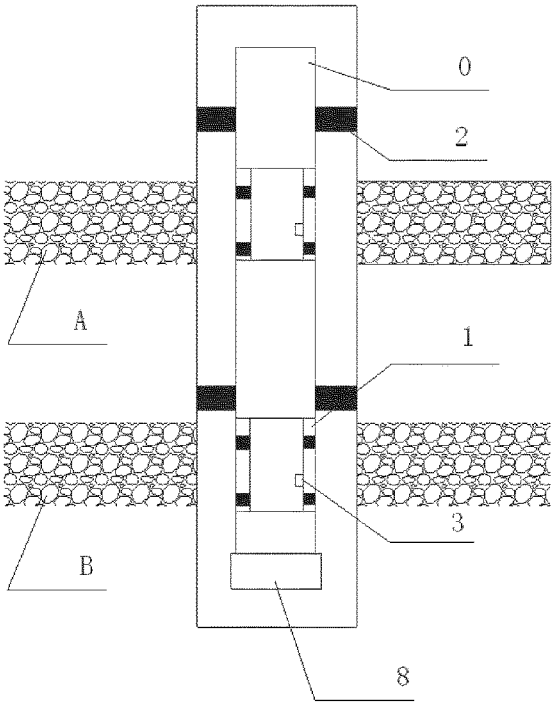
PRIOR ART Fig. 1
FIG. 1 is a schematic diagram of the control of the separate-layer flow by a water nozzle for separate-layer water injection.
Figure 2A:
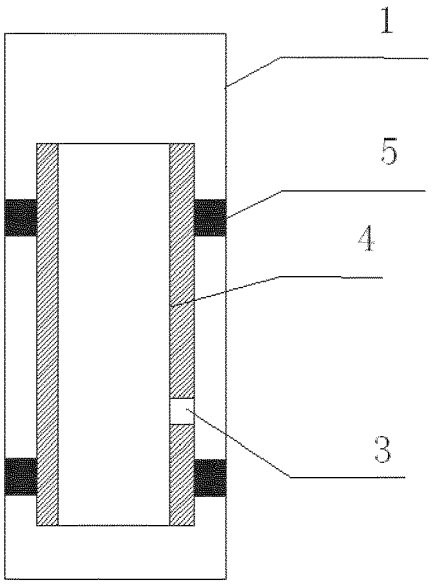
PRIOR ART Fig. 2a
FIG. 2*a* is a schematic diagram of the structure of a water distributor.
Figure 2B:
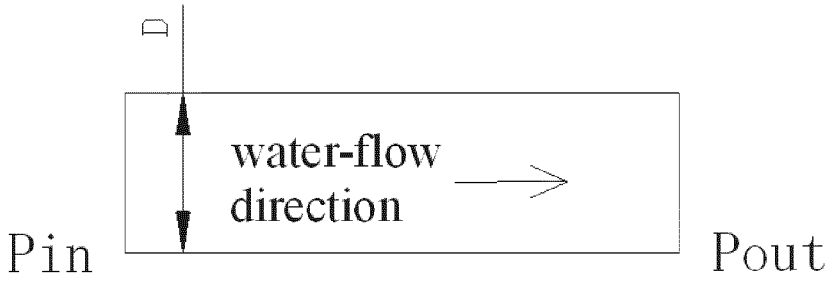
PRIOR ART Fig. 2b
FIG. 2*b* is a schematic diagram illustrating the principle for flow control by the water nozzle of the water distributor.
Figure 3:
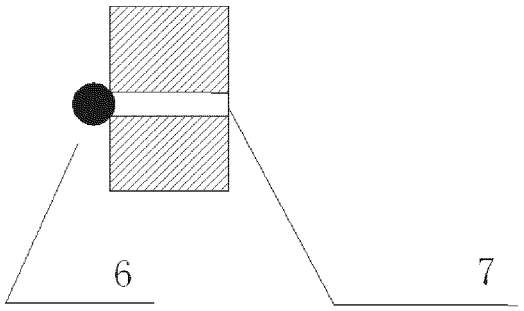
FIG. 3 is a schematic diagram illustrating defects in using a gas nozzle in a separate-layer gas injection method.
Figure 4A:
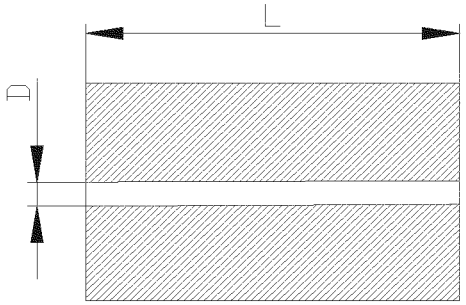
FIG. 4*a* is a schematic diagram of the structure of a single straight-hole model.
Figure 4B:
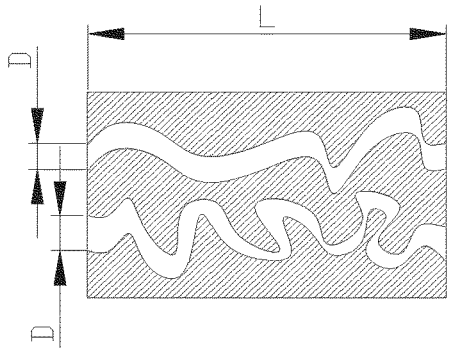
FIG. 4*b* is a schematic diagram of a pipeline structure model with high tortuosity.
Figure 5:
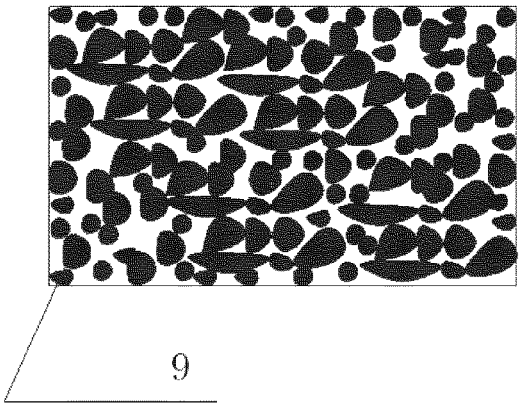
FIG. 5 is a schematic diagram of the pore structure in sandstone.
Figure 6A:
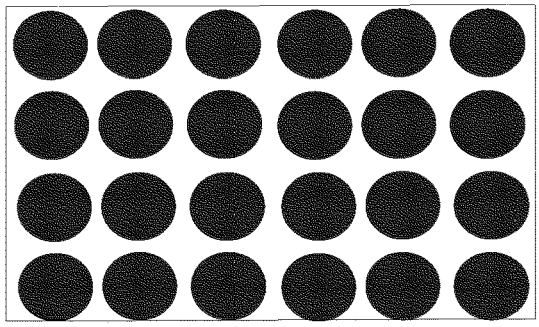
FIG. 6*a* is a schematic diagram of sandstone with a uniform pore structure.
Figure 6B:
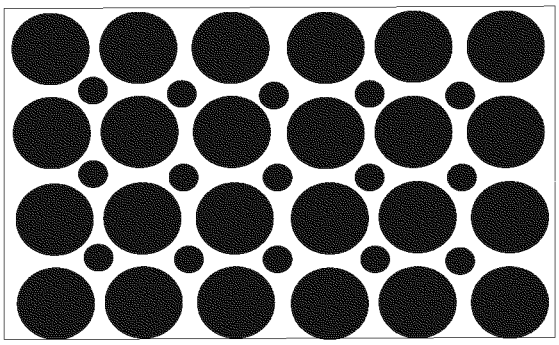
FIG. 6*b* is a schematic diagram of sandstone with a dense pore structure.
Figure 7A:
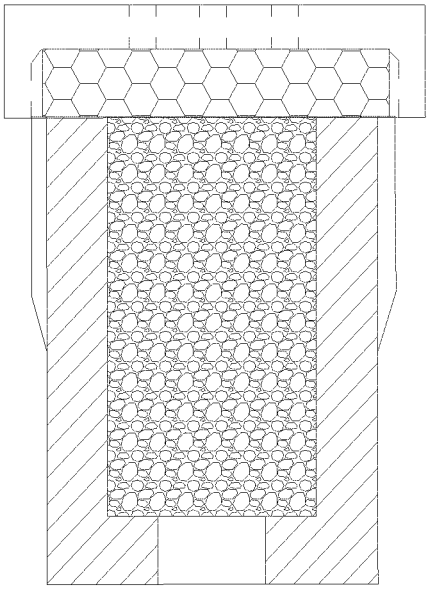
FIG. 7*a* is a schematic diagram of the structure of the gasflow distribution device according to an embodiment of the present disclosure.
Figure 7B:
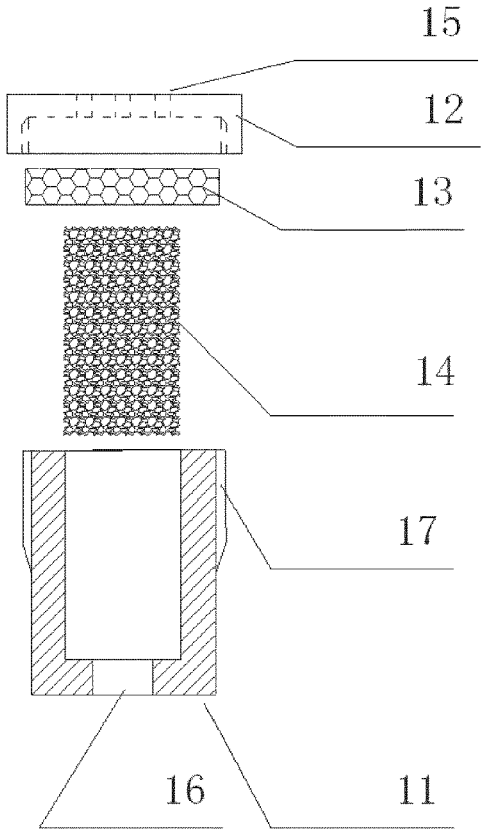
FIG. 7*b* is a schematic exploded view of each component of the gasflow distribution device according to an embodiment of the present disclosure.

This Example provides a gasflow distribution device 10 which is illustrated in FIGS. 7*a* to 7*b* which shows a schematic diagram of its structure. As can be seen from FIGS. 7*a* to 7*b*, the gasflow distribution device includes an outer pipe 11, a gland 12, a filter screen 13 and a filling block with a pore structure 14.

The outer pipe is a hollow outer pipe, used for containing a filling block with a pore structure, with an open upper end and a lower end with a bottom of which the center part is provided with a bottom hole 16, wherein the filling block is sealed to the inner wall of the outer pipe.

The gland has a bottom end provided with a circular groove for setting the filter screen which is sealed to the inner wall of the circular groove, and a top end distributed evenly with a plurality of top holes 15 through the gland.

The gland is connected to the outer pipe via an inner screw thread 17, and the filter screen is pressed tightly against the filling block with a pore structure after the gland is connected to the outer pipe.

In this Example, the outer pipe used may have an inner diameter of 10 to 15 mm, and a length of 100 to 150 mm.

In this Example, the bottom hole may have a diameter of not less than 3 mm, for example, 4 mm.

In this Example, the filter screen is a screen with a mesh of 80.

In this Example, the top holes have a number of 5 to 9, and a diameter of 1 mm.

In this Example, an amount of epoxy resin is filled between the filling block and the inner wall of the outer pipe so that they are sealed after curing.

In this Example, an amount of epoxy resin is filled between the filter screen and the inner wall of the circular groove so that they are sealed after curing.

In this Example, the filling block with a pore structure is sintered from titanium nano-scale particles in a high-pressure and oxygen-free environment.

In this Example, the titanium nano-scale particles have a diameter of 30 to 50 nm.

In this Example, the filling block with a pore structure has a pore permeability (Kc) which is not higher than 0.1 times of the permeability (Kr) of the target reservoir, a channel diameter of 1 to and a tortuosity of 1.4 to 1.57 based on the uniform distribution of the whole particles.

Example 2

Figure 8:
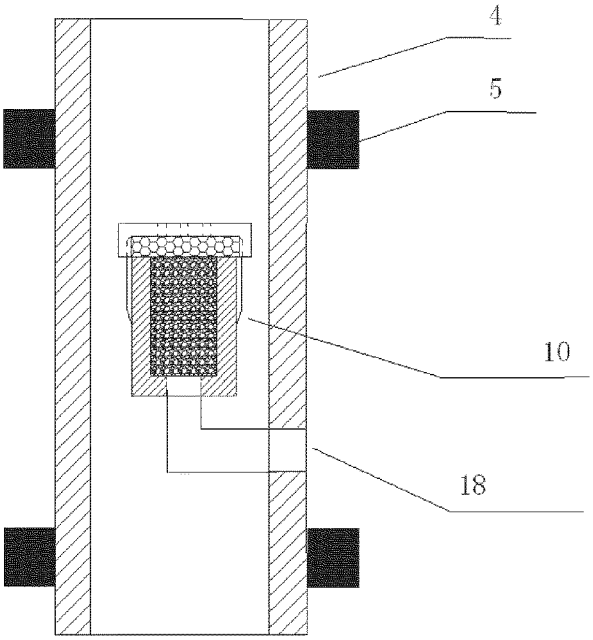
FIG. 8 is a schematic diagram of the structure of the gas distributor according to an embodiment of the present disclosure.

This Example provides a gas distributor (as shown in FIG. 8), which includes a core 4 having an outer wall of which the upper and lower ends are sleeved with O-rings 5 respectively, and having a sidewall which is provided with sidewall holes 18, wherein the gas distributor further includes the gasflow distribution device 10 in the Example 1 provided inside the core, wherein the bottom holes of the gasflow distribution device are connected to the sidewall holes of the gas distributor through pipelines.

Example 3

Figure 9:
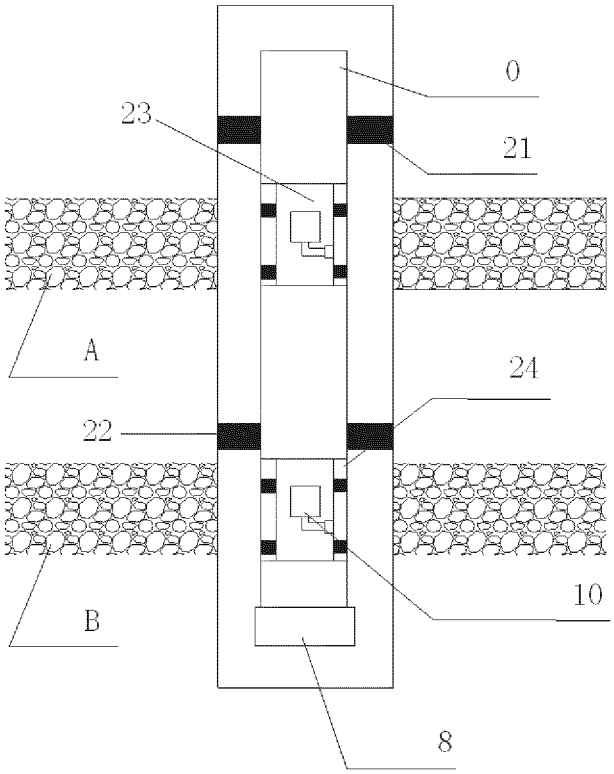
FIG. 9 is a schematic diagram of the structure of the pipe string for separate-layer gas injection according to an embodiment of the present disclosure.

This Example provides a pipe string for separate-layer gas injection, which is illustrated in FIG. 9 showing a schematic diagram of its structure. As can be seen from FIG. 9, it includes a heat insulating oil pipe 0, two packers (a first packer 21 and a second packer 22), two gas distributors (a first gas distributor 23 and a second gas distributor 24) provided in Example 2, and a screwed plug 8. The first packer, the first gas distributor, the second packer, and the second gas distributor are connected to the heat insulating oil pipe at intervals in sequence, and the heat insulating oil pipe has a bottom end which is sealed up by the screwed plug 8.

The ratio between the permeabilities of the filling block with a pore structure used in the gasflow distribution device in the gas distributor for different oil layers is the same as the ratio between the gas injection volumes for the corresponding oil layers.

Example 4

This Example provides a method for separate-layer gas injection, including the following steps, by taking two oil layers for separate injection as an example to illustrate the operation process:

Step 1) Preparation of the Gasflow Distribution Device

The filling block in the gasflow distribution device is determined according to the ratio of the gas volume for separate-layer injection in the oil layer.

The filling block may have the same diameter and length due to the unified size of the outer pipe used by the gasflow distribution device. Generally, the formation flowing pressures (the fluid pressure outside the gas distributor) in the two oil layers are almost the same, and the gas pressures in the wellbore are almost the same in the two oil layers (since the two oil layers have a smaller interval, usually a few meters, and the gas pressure difference is less than 0.05 MPa), so that the pressure differences between the inside and outside of the gas distributor in the two oil layers are close. It is known from Equation 3 that the flow rate Q is linearly proportionated with K.

Assuming that the ratio between the gas injection volumes for the first oil layer A and the second oil layer B is n, the ratio between the permeabilities K of the filling blocks installed in the first oil layer A and the second oil layer B is also n.

After selecting the appropriate filling blocks, the gasflow distribution device is installed in the core of the gas distributor, as shown in FIG. 8.

Step 2) Installing the Device, after it is Assembled, at the Corresponding Position in the Oil Layer The core is installed in the gas distributor according to the separate-layer water injection process. Then the gas distributor is connected to the packer, and further connected to the heat insulating oil pipe and installed at the corresponding position in the oil layer, as shown in FIG. 9.

Step 3) Distributing Gas Flow Automatically and Proportionally During the Gas Injection No other operation for adjustment and controlling is required during the gas injection. The gas flow is distributed automatically to the corresponding oil layer according to the ratio n as set in the device.

Similarly, in the case of multiple oil layers, it is only necessary to use multiple gas distribution devices in series.

Step 4) Replacement

In the process of gas injection, if the ratio of the gas injection volume in the oil layer needs adjustment, the core may be taken out by sending down a gripping device, similarly with the water injection process, to replace the core, which is simple and easy.

The above are only specific Examples of the present disclosure and cannot be used to limit the scope of the disclosure. Therefore, the substitution of equivalent components, or equivalent changes and modifications made in accordance with the scope of patent protection of the present disclosure should still belong to the scope covered by the present application. In addition, the technical features and technical inventions in the present disclosure may be freely combined with other technical features and technical inventions, including combination of the technical features and the technical inventions.

What is claimed is:

1. A gasflow distribution device, the gasflow distribution device comprising:

an outer pipe, a gland, a filter screen, and a filling block with a pore structure;

wherein the outer pipe is a hollow outer pipe with an open upper end and a lower end with a bottom of which the center part is provided with a bottom hole, and wherein the filling block with a pore structure is contained in the outer pipe and sealed to an inner wall of the outer pipe;

wherein the gland has a bottom end provided with a circular groove for setting the filter screen which is sealed to the inner wall of the circular groove, and a top end distributed evenly with a plurality of top holes through the gland; and wherein the gland is connected to the outer pipe via an inner screw thread.

2. The gasflow distribution device according to claim 1, wherein the bottom hole has a diameter of not less than 3 mm.

3. The gasflow distribution device according to claim 1, wherein the filter screen is a screen with a mesh of 60 to 100.

4. The gasflow distribution device according to claim 3, wherein the filter screen is a screen with a mesh of 80.

5. The gasflow distribution device according to claim 1, wherein the top hole has a diameter of 1 to 2 mm.

6. The gasflow distribution device according to claim 5, wherein the top hole has a diameter of 1 mm.

7. The gasflow distribution device according to claim 1, wherein an amount of epoxy resin is filled between the filling block and the inner wall of the outer pipe so that they are sealed after curing.

8. The gasflow distribution device according to claim 1, wherein an amount of epoxy resin is filled between the filter screen and the inner wall of the circular groove so that they are sealed after curing.

9. The gasflow distribution device according to claim 1, wherein the filling block with a pore structure has a channel diameter of 1 to 2 μm, and a tortuosity of 1.4 to 1.57.

10. The gasflow distribution device according to claim 9, wherein the filling block with a pore structure has a tortuosity of 1.57.

11. The gasflow distribution device according to claim 9, wherein the filling block with a pore structure is sintered from titanium nano-scale particles in a high-pressure and oxygen-free environment.

12. The gasflow distribution device according to claim 11, wherein the titanium nano-scale particles have a diameter of 30 to 50 nm.

* * * * *